US007025345B2

(12) United States Patent
Frazier et al.

(10) Patent No.: US 7,025,345 B2
(45) Date of Patent: Apr. 11, 2006

(54) REPLACEMENT METHOD AND ASSEMBLY FOR PAPER PICK ROLLERS

(75) Inventors: Isaac S. Frazier, Portland, OR (US); Jos W. Jacobs, Tigard, OR (US); Carl T. Urban, Portland, OR (US); David B. Schaefer, Wilsonville, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/753,606

(22) Filed: Jan. 8, 2004

(65) Prior Publication Data

US 2005/0151312 A1 Jul. 14, 2005

(51) Int. Cl.
*B65H 3/06* (2006.01)

(52) U.S. Cl. ..... 271/109; 271/121; 271/162; 384/418; 384/419

(58) Field of Classification Search ..... 271/109, 271/113, 121, 122, 162, 272, 273; 384/418, 384/419
See application file for complete search history.

(56) References Cited

U.S. PATENT DOCUMENTS

| | | | | |
|---|---|---|---|---|
| 4,565,360 | A * | 1/1986 | Runzi | 271/4.04 |
| 5,039,080 | A * | 8/1991 | Kato et al. | 271/122 |
| 5,265,859 | A * | 11/1993 | Watson et al. | 271/109 |
| 5,421,569 | A | 6/1995 | Davidson | |
| 5,624,109 | A * | 4/1997 | Tanaka | 271/10.13 |
| 5,709,380 | A * | 1/1998 | Petocchi et al. | 271/125 |
| 5,720,478 | A | 2/1998 | Carter et al. | |
| 5,769,410 | A | 6/1998 | Davidson et al. | |
| 5,921,539 | A * | 7/1999 | Westcott et al. | 271/10.03 |
| 6,059,279 | A | 5/2000 | Wenthe, Jr. | |
| 6,120,018 | A * | 9/2000 | Amano | 271/122 |
| 6,173,951 | B1 * | 1/2001 | Inoue et al. | 271/121 |
| 6,325,560 | B1 * | 12/2001 | Hirabayashi et al. | 400/636 |
| 6,565,078 | B1 * | 5/2003 | Foglino et al. | 271/124 |
| 6,626,596 | B1 * | 9/2003 | Hirabayashi et al. | 400/636 |
| 6,666,446 | B1 * | 12/2003 | Gaarder et al. | 271/10.04 |
| 2002/0008349 | A1 * | 1/2002 | Miki | 271/122 |
| 2002/0190460 | A1 | 12/2002 | Gaarder et al. | |

FOREIGN PATENT DOCUMENTS

| | | |
|---|---|---|
| EP | 0 296 850 A2 | 12/1988 |
| JP | 2000 203728 A | 7/2000 |

OTHER PUBLICATIONS

European Search Report dated May 9, 2005 corresponding to European Application No. EP 05 00 0163.5.

* cited by examiner

*Primary Examiner*—Donald P. Walsh
*Assistant Examiner*—Thomas Morrison
(74) *Attorney, Agent, or Firm*—Fay, Sharpe, Fagan, Minnich & McKee, LLP

(57) ABSTRACT

A sheet feeder and separator assembly for separating and sequentially feeding individual print media sheets from a stack thereof includes a frame having at least one bearing recess. A removable print media tray is carried by the frame. A separator is connected to the removable print media tray. A pick module assembly is removably connected to the frame adjacent the removable print media tray. The pick module assembly includes a pick roller adjacent the separator to form a nip and at least one flexible bearing is removably received in the at least one bearing recess to removably connect the pick module assembly to the frame.

14 Claims, 11 Drawing Sheets

REPLACEMENT METHOD AND ASSEMBLY FOR PAPER PICK ROLLERS

BACKGROUND

The present application relates to a removable pick module for use in a sheet feeding office machine such as a printer, photocopier or high capacity paper feeder. More particularly, the present application relates to a removable pick module assembly for use in a sheet feeding office machine and a method for inserting and removing said module assembly and will be described with particular reference thereto. However, it is to be appreciated that the removable pick module assembly and method may relate to other similar environments and applications.

Pick system rollers generally have more wear issues than any other rollers in a sheet feeding machine and, therefore, are the most likely to require replacement during the life of a sheet feeding office machine. In some prior art sheet feeding machines, the rollers were permanently mounted to shafts which required a service technician to disassemble the product to replace the rollers. More recently, some manufacturers have made the pick rollers in their machines removable so that they can be replaced by the user. However, this process can often be difficult and non-intuitive. Further, this process may still require the user to obtain additional service support.

In some products, the rollers are replaced by lifting a tab on a roller hub and sliding the roller off a shaft. This is often difficult, particularly, when the roller is deep inside a printer. In such products as auto document feeders, where access can be gained from above, some designs allow two or three rollers to be replaced simultaneously by combining them into a pick module. These pick modules are, however, still often difficult to be replaced by a user without additional service support. Moreover, when access from above is unavailable, such as in some printer devices, these designs may fail to allow user replacement. Thus, there is a need for a replaceable pick module, usable with sheet feeding devices where access may not be available from above the device, that can be installed and removed by a user in a relatively easy manner.

BRIEF SUMMARY

A sheet feeder and separator assembly for separating and sequentially feeding individual print media sheets from a stack thereof includes a frame having at least one bearing recess. A removable print media tray is carried by the frame. A separator is connected to the removable print media tray. A pick module assembly is removably connected to the frame adjacent the removable print media tray. The pick module assembly includes a pick roller adjacent the separator to form a nip and at least one flexible bearing is removably received in the at least one bearing recess to removably connect the pick module assembly to the frame.

DETAILED DESCRIPTION

Figure 1:
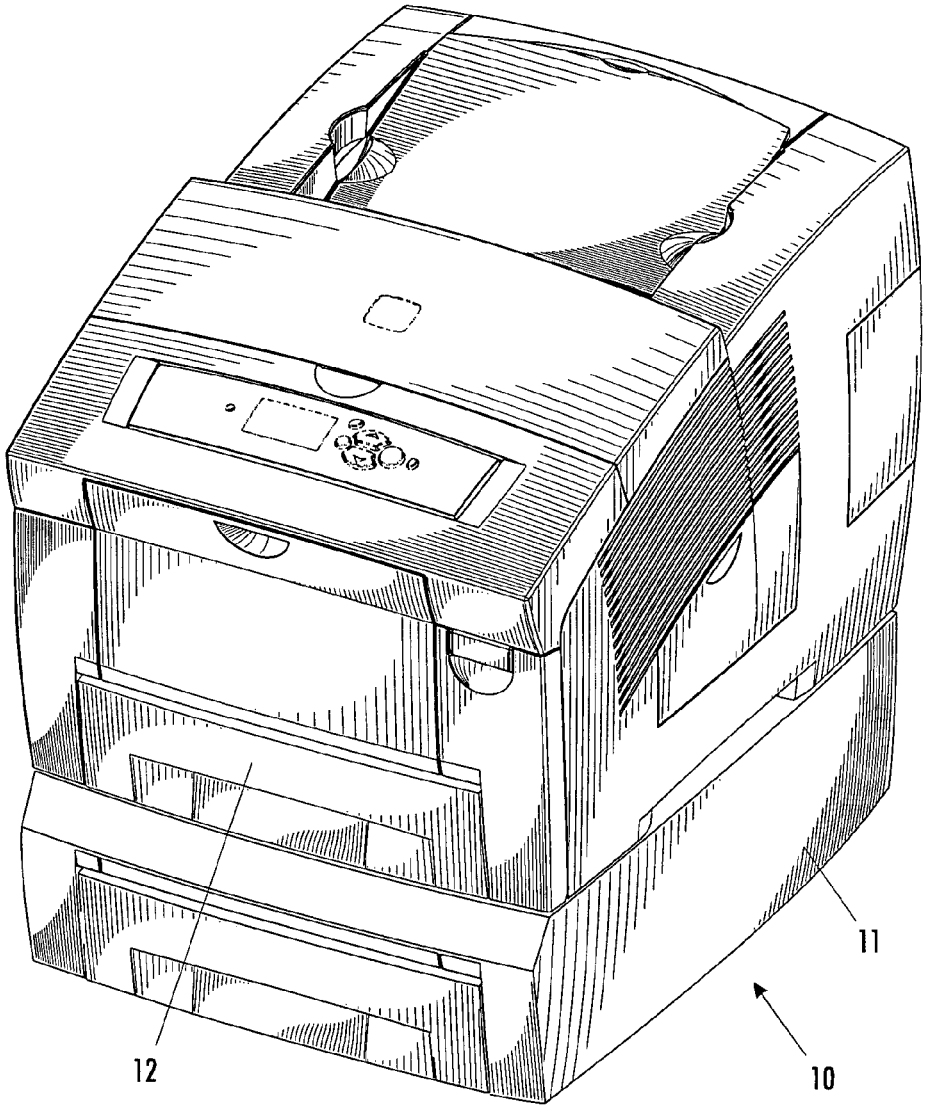
FIG. 1 is a perspective view of a printing device having a sheet feeder and separator assembly.

Referring now to the drawings wherein the showings are for purposes of illustrating an embodiment and not for purposes of limiting the same, a printer device is shown in FIG. 1 and generally designated by reference numeral 10. The printer device 10 is shown as including or being positioned on an auxiliary high capacity feeder 11. As will be described in more detail below, the printer device 10 includes a sheet feeder and separator assembly for separating and sequentially feeding individual print media sheets from a stack of print media sheets. The high capacity feeder 11 also includes a sheet feeder and separator assembly which is substantially similar to that of the printer device 10 and, for this reason, only the feeder and separator assembly of the printer device 10 will be described in further detail.

More particularly, the printer device 10 includes a removable print media tray 12 that is suitable for receiving a stack of print media sheets, such as various grades of paper, transparencies or the like. The sheet feeder and separator assembly is able to pull a single sheet from the stack of print media sheets held by the print media tray 12 and deliver the single sheet further into the printer device for printing thereon. After a first sheet is fed further into the printer device, subsequent sheets can be sequentially fed one at a time.

Figure 2A:
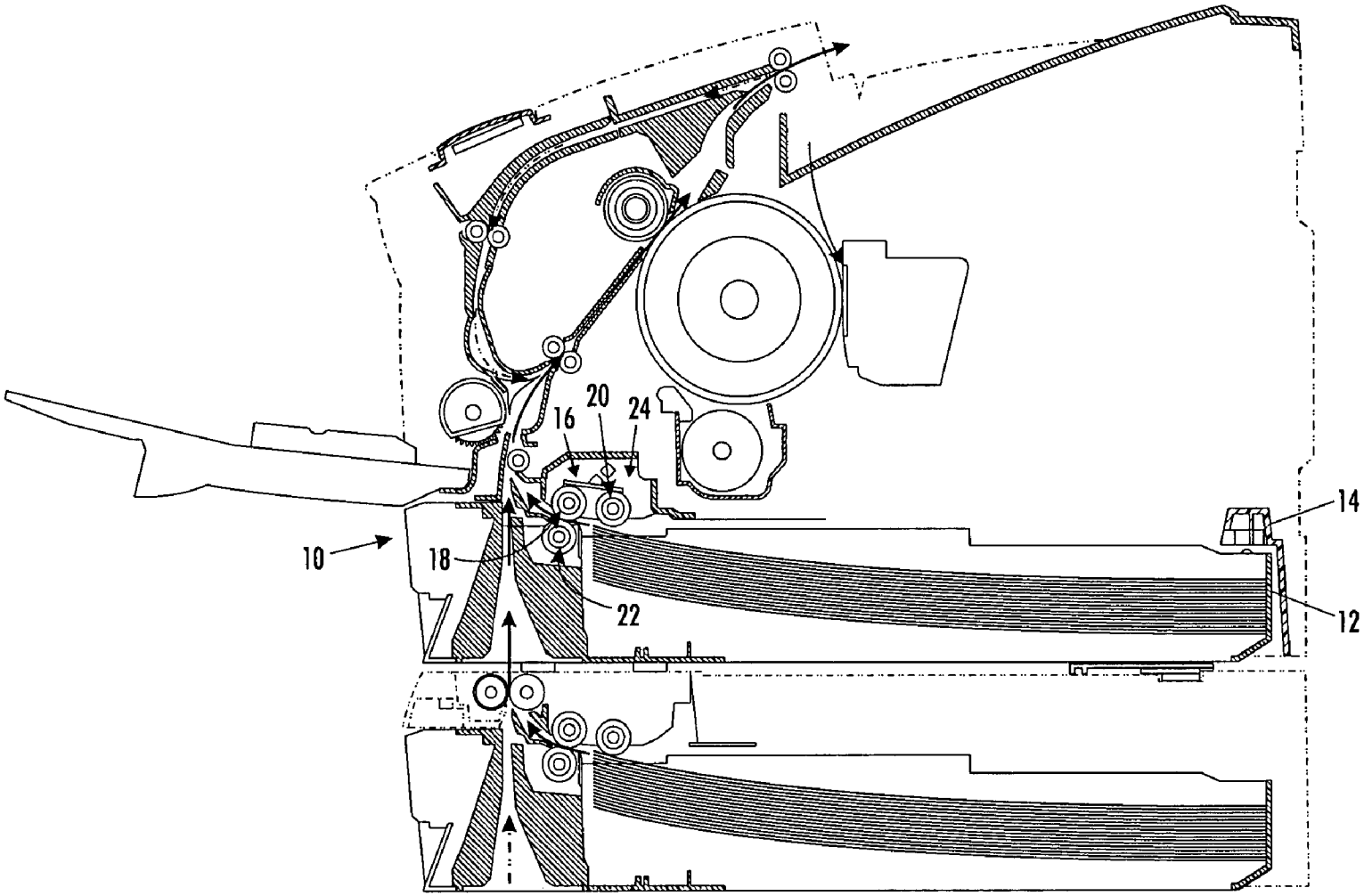
FIG. 2*a* is a cross-sectional view of the printing device of FIG. 1 showing a pick module assembly, a removable print media tray and a retard roller assembly.
Figure 2B:
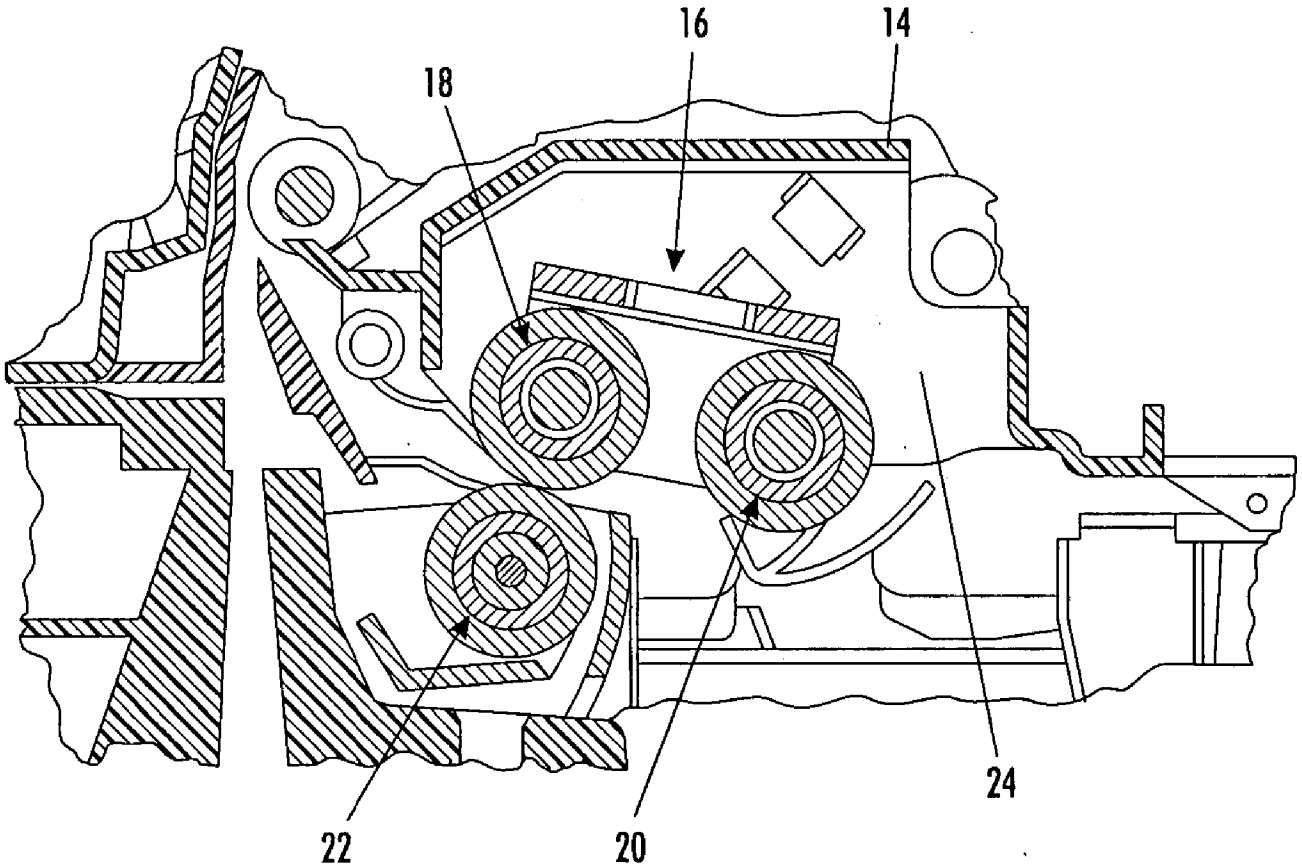
FIG. 2*b* is an enlarged partial cross-sectional view of the printing device of FIG. 2*a;*

With additional reference to FIGS. 2*a* and 2*b*, the removable print media tray 12 is carried by a frame 14 of the printer device. The tray 12 is a drawer-type tray that slides into a front of the printer device 10 on one or more tracks connected to or defined by the frame 14. In the embodiment described herein the frame 14 is constructed of a substantially rigid material such as Noryl® (modified PPO) (Polyphenylene Oxide) which is known to have relatively good electrical insulating properties and dimensional stability.

A replaceable pick module assembly 16 is removably connected to the frame 14 adjacent the tray 12 as will be described in more detail below. The pick module assembly 16, also referred to herein as a customer replaceable unit, includes a first or pick roller 18 and a second or nudger roller 20. A separator 22 is connected to the tray 12 such that when the tray is fully inserted into the printer device 10, the separator is positioned adjacent or close to the pick module assembly 16. More particularly, the pick module assembly 16 and the pick roller 18 are positioned adjacent to the separator 22 such that the pick roller 18 and the separator form a nip for receiving single or multiple sheets of print media therein. The nudger roller 20 is positioned inwardly of pick roller 18 and together the pick roller 18, the nudger roller 20 and the separator 22 are able to pick a single print media sheet from a stack of print media sheets carried in the tray 12 while retarding all other sheets other than the single, selected sheet. The single sheet can then be fed between the separator 22 and the pick roller 18 and delivered further into the printer device 10 for further processing or printing thereon.

With continued reference to FIGS. 2*a* and 2*b*, the frame 14 defines a pick module recess 24 for receiving the pick module assembly 16. With additional reference to FIG. 3, the pick module assembly 16 includes flexible connecting members which, in the illustrated embodiment, are a pair of bearings: first flexible bearing 30 and second flexible bearing 32. The bearings 30,32 are removably received in respective first and second bearing recesses 34,36 which are positioned adjacent the pick module recess 24 to removably connect the pick module assembly 16 to the frame 14. Due to the rigidity of the frame 14, the wall structures 38,40 of the frame 14 that define the bearing recesses 34,36 substantially resist deformation and are substantially inflexible when the bearings 30,32 are inserted or removed from the recesses 34,36.

Figure 4:
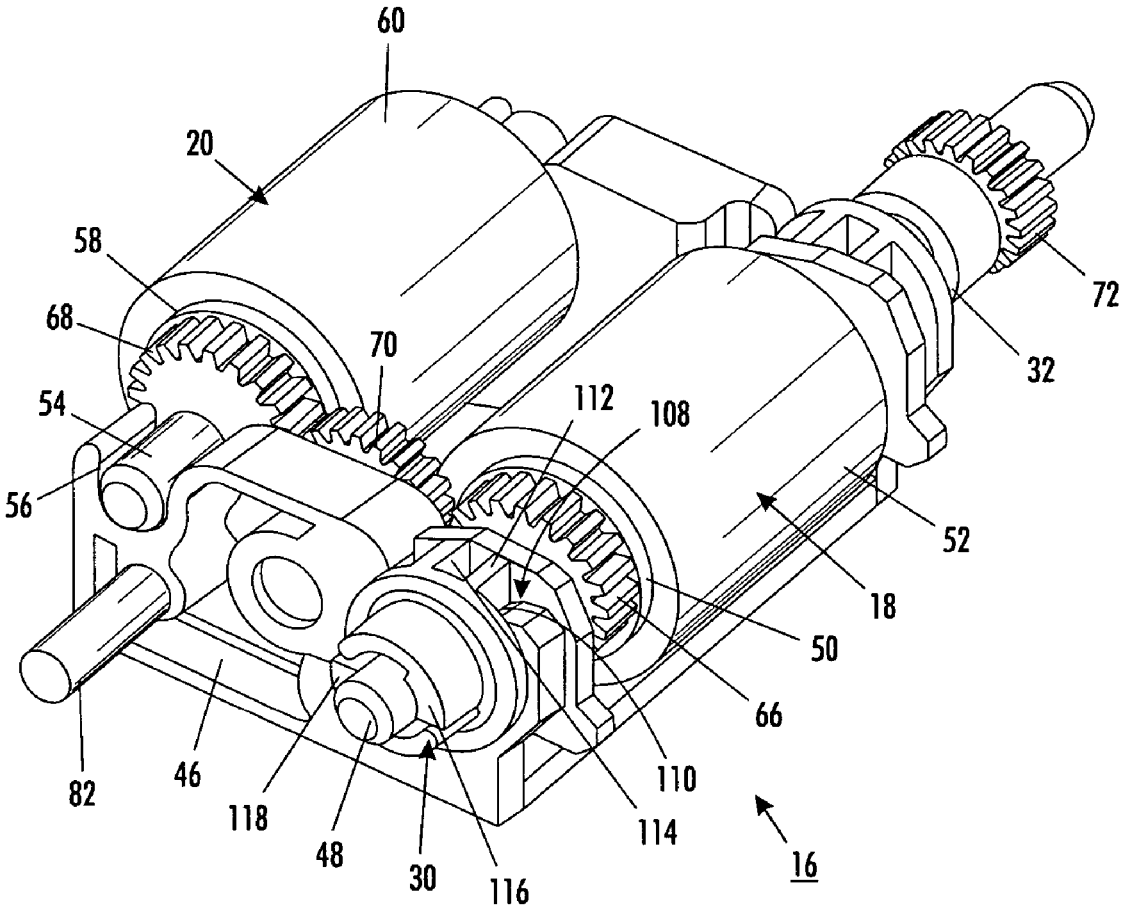
FIG. 4 is a perspective view of the pick module assembly shown removed from the frame of the printing device and having a pair of flexible bearings.

With reference to FIG. 4, the pick module assembly 16 includes a pick frame 46 to which the pick roller 18 and the nudger roller 20 are rotatably mounted adjacent one another. The assembly 16 further includes a pick roller shaft 48 rotatably mounted to the pick frame 46 by the bearings 30,32. The pick roller 18 is connected to the pick roller shaft 48 and, more specifically, includes a hub 50, a one-way bearing (not shown) connecting the hub 50 to the shaft 48 and a frictional roller tread 52 fixed to the hub 50. The one-way bearing rotatably fixes the pick roller 18 to the shaft 48 when the shaft is rotated in a first direction (clockwise in FIG. 4) and rotatably connects the pick roller 18 to the shaft when the shaft 48 is rotated in an opposite, second direction (counterclockwise in FIG. 4). Alternately, the pick roller could be an integral part of the pick shaft. Such an arrangement could necessitate (for example with a solenoid or a cam) lifting the nudger roller 20 off a stack of media sheets after a single sheet from the stack has moved into the nip between the integrally molded pick roller and the separator 22 to prevent multiple sheets from being forced into the nip each time a single sheet is attempted to be picked from the stack. This alternate arrangement should be considered within the scope of the embodiment(s) herein described.

The nudger roller 20 is rotatably connected to the pick frame 46 by a nudger shaft 54 which is positioned adjacent the pick roller 18. More specifically, the nudger shaft 54 is rotatably received and held in pick frame recesses 56 formed as part of the pick frame 46. Like the pick roller 18, the nudger roller 20 is connected to the nudger shaft 54 and, more specifically, includes a hub 58, a one-way bearing (not shown) connecting the hub 58 rotatably to the shaft 54 and a frictional roller tread 60 fixed to the hub 58. Again, this one-way bearing rotatably fixes the nudger roller 20 to the shaft 54 when the shaft is rotated in the first direction (clockwise in FIG. 4) and rotatably connects the nudger roller 20 to the shaft 54 when the shaft 54 is rotated in the opposite second direction (counterclockwise in FIG. 4). Alternately, the nudger roller 20 could be an integral part of the shaft 54. The one-way bearing of the nudger roller 20 ensures that when a sheet gets pulled past the rollers 18,20, only the hub 58 and tread 60 of the nudger roller 20 rotate therewith. Without the one way bearing, it is likely that the nudger roller 20 would not rotate at all due to the high frictional and inertia forces.

The nudger shaft 54 is connected to the pick roller shaft 48 for rotation therewith such that rotation of the pick roller shaft 48 causes simultaneous rotation of the nudger shaft 54. More specifically, a pick roller gear 66 is rotatably fixed to the pick roller shaft 48. Likewise, a nudger roller gear 68 is rotatably fixed to the nudger shaft 54. An idler gear 70 is rotatably mounted to the pick frame 46 between the pick roller gear 66 and the nudger roller gear 68. Teeth of the idler gear 70 mesh with teeth of the pick roller gear 66 and the nudger roller gear 68 such that the idler gear 70 is engaged to both gears 66,68 so that rotation of the pick roller shaft 48 rotates the pick roller gear which rotates the nudger shaft 54 through the idler gear 70 and the nudger roller gear 68. A driven gear 72 is fixed to one end of the pick roller shaft 48 and positioned within the printer device 10 for selective engagement with an associated drive gear (not shown). Through a power means such as a motor (not shown), the associated drive gear is positioned to selectively rotate the driven gear 72 and, as described above, the pick and nudger rollers 18,20.

Figure 3:
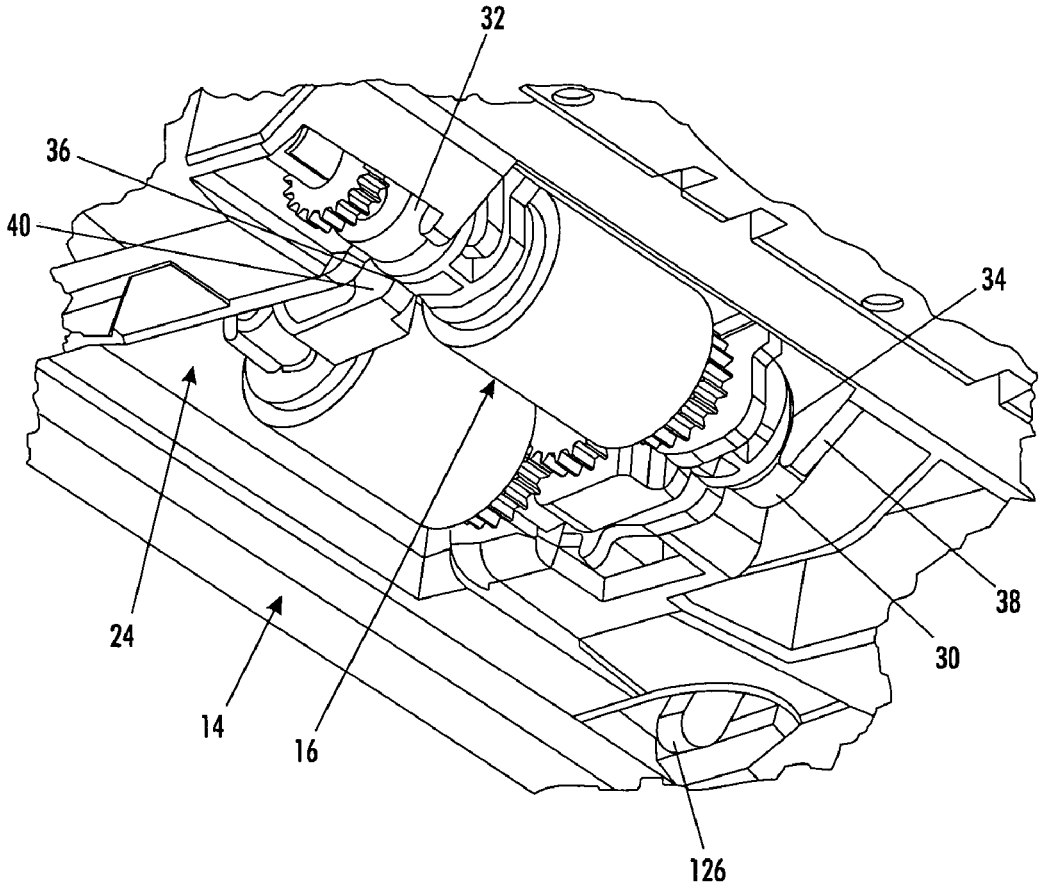
FIG. 3 is a partial perspective view of the pick module assembly operatively connected to a frame of the printing device.
Figure 5:
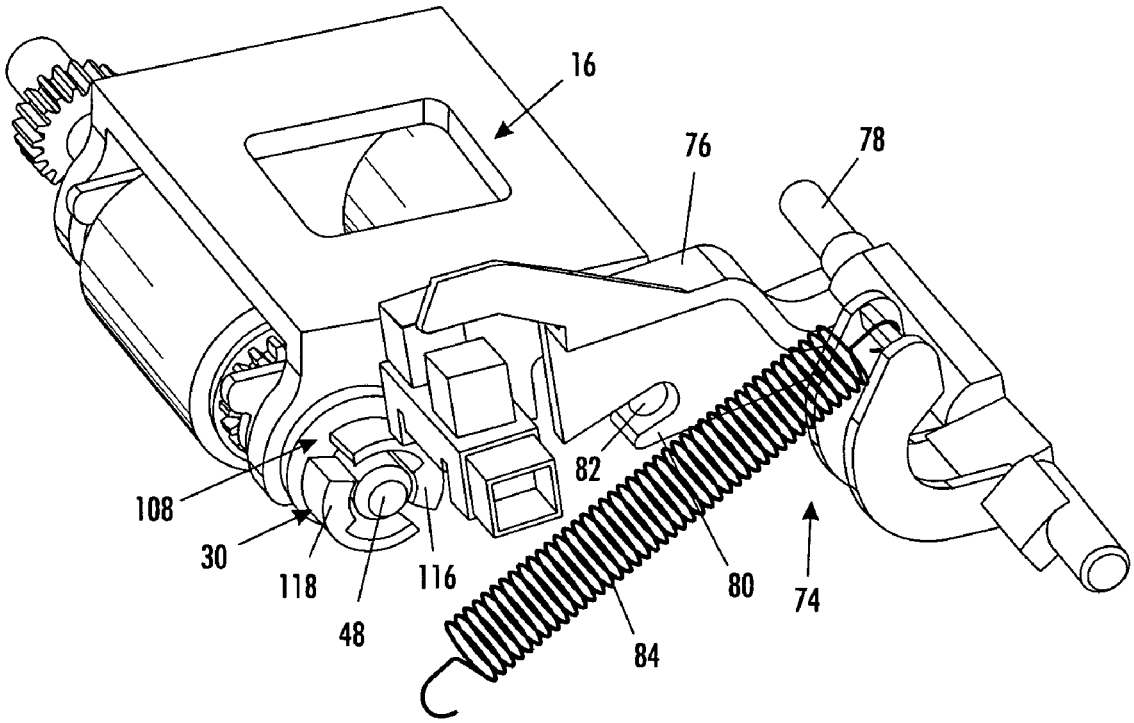
FIG. 5 is a perspective view of the pick module assembly and an actuator arm assembly for maintaining the pick module assembly in an operative position and selectively releasing the pick module assembly for removal from the frame.

With reference to FIG. 5, the sheet feeder and separator assembly further includes an actuator assembly 74 positioned adjacent the pick module assembly 16 in the frame 14. The actuator assembly 74 includes an arm 76 that is pivotally connected or mounted to the frame 14 (FIG. 3). More particularly, the arm 76 is integrally formed with an actuator shaft 78 that is rotatably connected to the frame 14 adjacent ends of the shaft 78. The arm 76 includes a fork 80 that engages an extending member 82 (FIG. 4) of the pick frame 46 when the pick module assembly 16 is connected to the frame 14 and in an operative position. The actuator assembly 74 further includes a biasing means, such as spring 84, that urges the actuator shaft 78 and, in turn, the actuator arm 76 to rotate in an actuator arm first direction (counterclockwise in FIG. 5). The frame 14 limits how far the arm 76 is able to rotate in the arm first direction. Of course, the biasing means could be any other device that would urge the arm 76 to rotate in the actuator arm first direction. Alternatively, the arm 76 or the extending member 82 could be constructed of a resilient or flexible material and pivoting of the arm 76 could be eliminated for purposes of engaging the arm 76 and the extending member 82.

Figure 6:
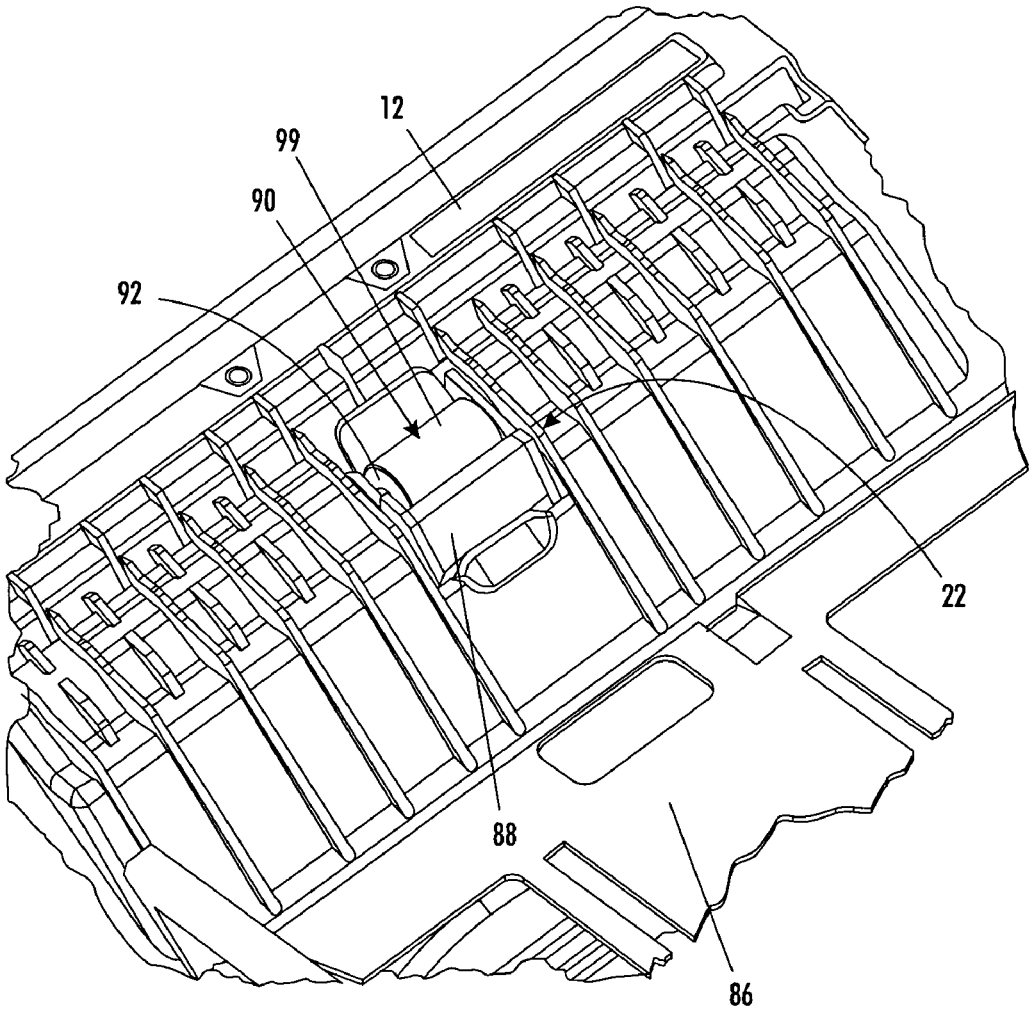
FIG. 6 is a partial perspective view of the print media tray and the retard roller assembly.
Figure 7:
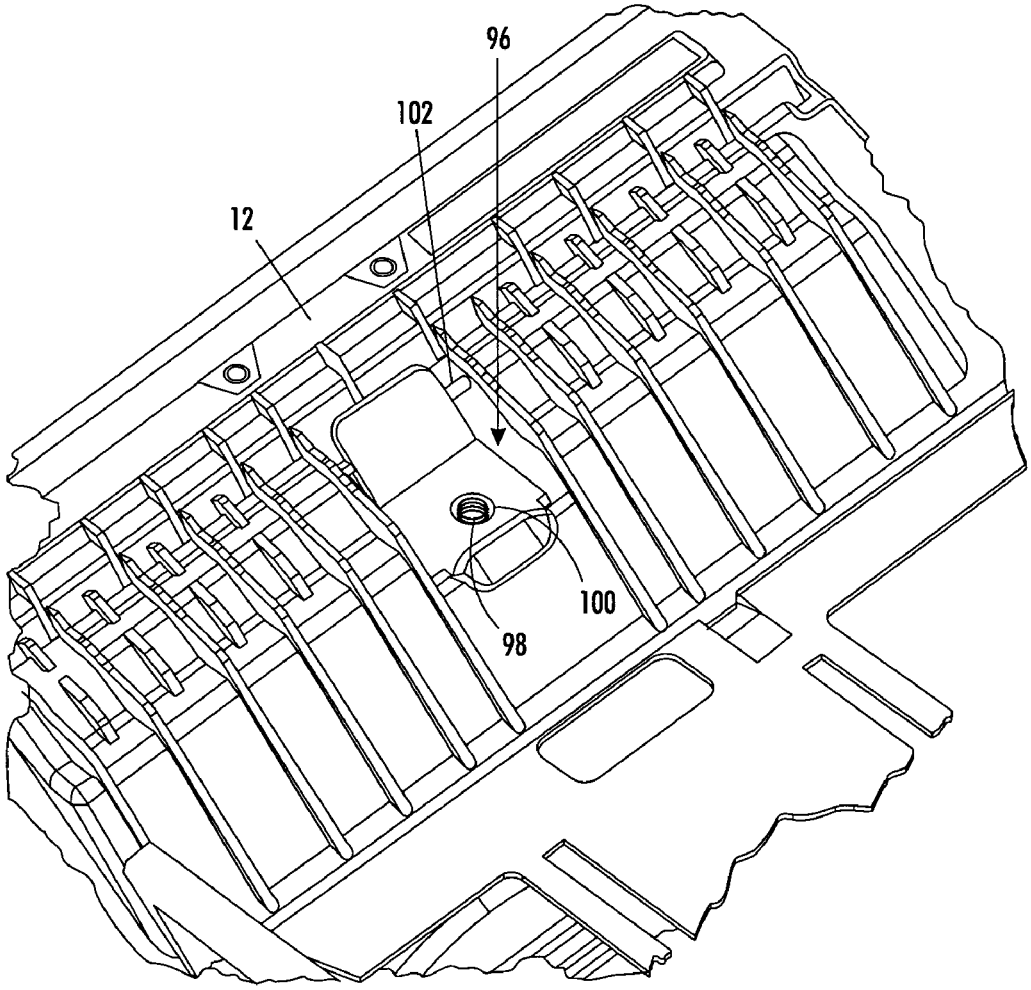
FIG. 7 is an enlarged partial perspective view of the print media tray shown with a retard roller of the retard roller assembly removed.

With reference to FIG. 6, the tray 12 includes the separator 22 and a lift plate 86 that raises a stack of print media carried in the tray 12 toward the sheet feeder and separator assembly. In the illustrated embodiment, the separator 22 is a retard roller assembly removably connected to the tray 12 which allows for replacement thereof. More specifically, the retard roller assembly includes a bracket 88 and a retard roller 90 rotatably mounted to the bracket 88. The retard roller 90 includes a hub 92 having axial projections rotatably connected to the bracket 88 and a frictional roller tread 94 rotatably fixed to the hub 92. With additional reference to FIG. 7, the retard roller 90 and bracket 88 are received within a retard recess 96 defined in the tray 12. Below the bracket 88, a bias means, such as spring 98, is connected to the tray 12 for urging the retard roller 90 into the pick roller 18 when assembled in the printer device 10. Of course, other devices could be used in place of the spring 98 to urge the retard roller 90 toward the pick roller 18 and the bias means is intended to include all such other devices. The spring 98 is received in a spring recess 100 and can be automatically retained by a snap tab feature during installation of the retard roller and bracket assembly. During replacement of the retard roller and bracket assembly, the spring can be threadedly disengaged from the tray's snap tab feature 12 within the recess 100 for easy removal from the tray 12. The spring 98 assists in providing a nip force between the retard roller 90 and the pick roller 18.

The bracket 88 includes recesses defined by flexible fingers (not shown) that engage or snap-on to the shaft projections 102 defined by the tray 12. The hub 92 is connected to the bracket 88 by a retard shaft (not shown) and a retard wrap spring (not shown). In one embodiment, the shaft is made of plastic to reduce manufacturing costs. The shaft removably connects to the bracket 88 by snapping into recesses or grooves (not shown) of the bracket 88 which enables relatively easy replacement of the entire retard roller assembly or just the shaft, hub 92 and tread 94 independent of the bracket 88. More specifically, the retard shaft is nonrotatably fixed to the retard bracket 88. The hub 92 is rotatably connected to the shaft with the retard wrap spring. The retard wrap spring provides a constant drag when the retard roller 90 is forced to rotate—for example directly by the pick roller 18 or by a sheet of print media in the nip. The retard roller 90 is able to prevent more than a single sheet of print media from being picked up because a retard torque (or drag torque) developed by the wrap spring causes a separation force higher than the force that keeps two or more sheets of the print media together.

In operation, the retard spring winds up slightly when providing the drag torque. Thus, when a trailing edge of a picked sheet of print media leaves the nip, the retard spring releases and kicks any other sheets out of the nip. Therefore, the retard roller acts as an active driven retard roller without being driven as a result of the wrap spring. For this reason, the use of a retard spring to urge the retard roller 90 toward the pick roller 18 classifies the retard roller assembly of the illustrated embodiment as having a semi-active retard roller.

Alternately, the retard roller assembly could be modified or substituted for a variety of other known retard roller assemblies. For example, an active retard roller could be used in place of the illustrated and described semi-active retard roller 90. An active retard roller could necessitate the use of a more complicated mechanism to transmit torque to the retard roller but could also allow for improved separation reliability of the sheets of print media. In another example, a separator pad could be used in place of the retard roller assembly. The use of the separator pad could reduce the complexity of the separator but may result in reduced separation reliability for the sheets of print media. In any case, the separator 22 is independent of the pick module assembly 16 and can be replaced independently of the pick module assembly 16.

Figure 8A:
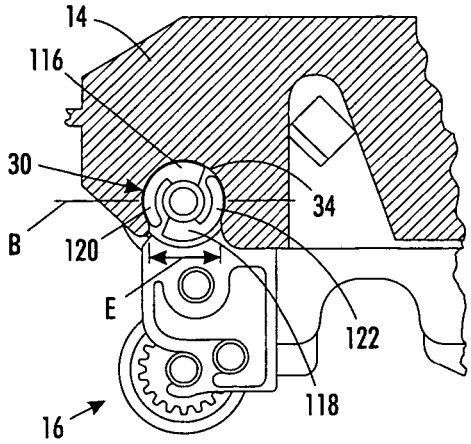
FIG. 8*a* is a partial cross-sectional view of the frame and the pick module assembly shown in a semi-engaged position.
Figure 8B:
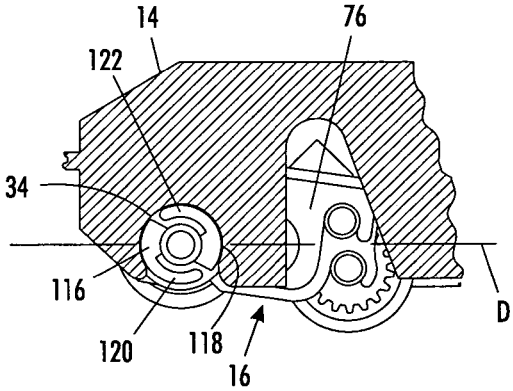
FIG. 8*b* is a partial cross-sectional view of the frame and the pick module assembly shown in an operatively engaged position.

With reference to FIG. 8*a*, the pick module assembly 16 is shown in a partially or semi-engaged position wherein the first bearing 30 is shown received in the first recess 34 of the frame 14. As will be discussed in more detail below, with the pick module assembly 16 in the semi-engaged position, the bearing 30 has an adjustable or compressible diameter that allows the bearing 30 to be removed from and, if desirable, reinstalled into the bearing recess 34. With reference to FIG. 8*b*, the pick module assembly 16 is shown in the operative position wherein the bearing 30 is received in the first recess 34 of the frame 14 and, with additional reference to FIG. 9*d*, the extending member 82 is engaged by the fork 80 of the actuator arm 76 locking the pick module assembly 16 in the operative position. As also will be discussed in more detail below, with the pick module in the operative position, the bearing 30 has a constant or non-compressible diameter which prevents the bearing 30 from being removed from the recess 34 and substantially prevents transverse movement of the pick module assembly 16 relative to the bearing recess 34.

In the illustrated embodiment, both flexible bearings 30,32 are substantially similar and only one will be discussed in further detail. With additional reference to FIG. 8*c*, the bearing 30 has a diameter or first dimension A that is variable, flexible and/or adjustable along a first axis or direction B. The bearing has another diameter or second dimension C that is constant, rigid and/or relatively inflexible along a second axis or direction D. The second axis D is angularly offset relative to the first axis B. More particularly, in the illustrated embodiment, the second axis D is approximately normal to the first axis B. Although the shape of bearing 30 in the illustrated embodiment is circular, it should be understood that the shape of the bearings could be modified or substituted for and all such modifications or substitutions are to be considered within the scope of the described embodiment. For example, the bearings could have a solid double D or oval shape.

More specifically, with reference to FIGS. 4 and 5, the bearing 30 includes a grooved portion 108 which is received within a bearing recess 110 of the pick frame 46 to connect the bearing 30 to the pick frame 46. A pair of spaced wall portions 112,114 are axially disposed or positioned in the grooved portion 108 of the bearing 30 to limit relative rotation of the bearing 30 within the bearing recess 110. With additional reference to FIG. 8*c*, an axially extending portion is adjacent the grooved portion 108 and includes opposed radial portions 116,118 adjacent the pick roller shaft 48 that have a substantially fixed diameter thereacross and opposed fingers 120,122 extending from the radial portions 116,118 and radially spaced from the pick roller shaft 48. The opposed fingers 120,122 have a flexible, varying diameter thereacross. Further, the fingers 120,122 extend radially from the radial portions 116,118 and are axially spaced from the grooved portion 108 of the bearing 30. This arrangement allows the fingers 120,122 to flex or bend which thereby allows the diameter across the fingers to vary.

With reference to FIG. 8*a*, the first bearing recess 34 is shown with the first flexible bearing 30 removably connected thereto. The recess 34 has an opening width E that is smaller than the diameter of the bearing. Because the frame 14 defining the recess 34 is rigid and substantially inflexible, the bearing diameter has to be variable to allow for insertion and removal of the bearing 30. More particularly, to install and remove the bearing 30 from the recess 34, the variable first dimension A of the bearing 30 is generally aligned with the opening width E of the bearing recess 34 as shown in FIG. 8*a*. Thus, the first axis B of the bearing is aligned with the opening width E which positions the fingers 120,122 on either side of the recess. Since the fingers 120,122 are able to flex, the bearing 30 can flex for removal from and insertion into the bearing recess 34. To remove the pick roller assembly 16 from the frame 14, when the pick roller assembly 16 is in the semi-engaged position shown in FIG. 8*a*, the assembly 16 is pulled straight away from the bearing recess 34 which allows the fingers 120,122 to flex and permit removal. To reinstall the pick roller assembly, the fingers 120,122 are aligned with the recess 34 as shown in FIG. 8*a* and the pick module assembly is pushed straight into the bearing recess 34.

Figure 8C:
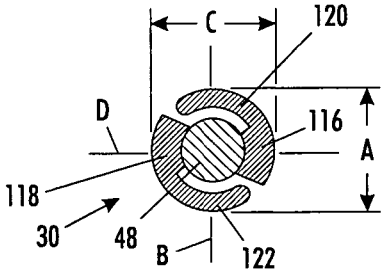
FIG. 8*c* is a partial elevational view of an axially extending portion of one of the flexible bearings on a pick shaft of the pick module assembly.

With reference to FIG. 8*b*, the pick module assembly is shown in an operative position. To get into this position from the semi-engaged position, the pick module assembly 16 is rotated (counterclockwise from FIG. 8*a* to FIG. 8*b*) until the radial portions 116,118 are aligned with the sides of the bear recess 34 as shown in FIG. 8*c*. The radial portions 116,118 fill across the bearing recess 34 and prevent removal of the pick module assembly until the first dimension A of the bearing 30 is again aligned with the opening width E. Moreover, the radial portions 116,118 fix the position and substantially prevent movement of the pick module assembly along the axis D relative to the frame when in the operative position. Thus, the pick module assembly 16 is locked to the frame 14 until the pick module assembly is rotated so that the first dimension A or first axis B is parallel or aligned with the opening width E.

Figure 9A:
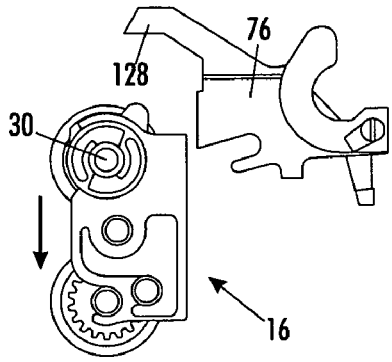
FIG. 9*a* is a partial view of the actuator arm assembly and the pick module assembly showing the pick module assembly in the semi-engaged position and ready for full installation into the frame.
Figure 9B:
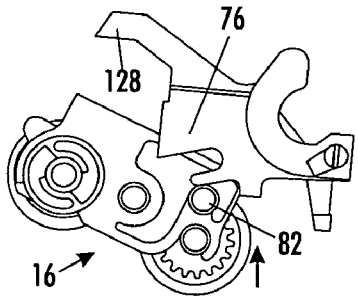
FIG. 9*b* is a partial view of the actuator arm assembly and the pick module assembly showing the pick module assembly initially engaging the actuator arm assembly.
Figure 9C:
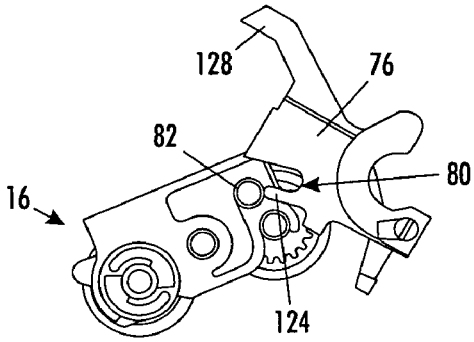
FIG. 9*c* is a partial view of the actuator arm assembly and the pick module assembly showing the pick module assembly pivoting the actuator arm assembly.
Figure 9D:
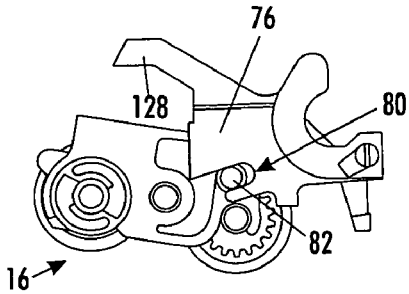
FIG. 9*d* is a partial view of the actuator arm assembly and the pick module assembly showing the pick module assembly in the operative, engaged position and locked therein by the actuator arm assembly.

With reference to FIG. 9*a*, to install the pick roller assembly 16 into the frame 14 and into the operative position, the bearings 30,32 (bearing 32 shown in FIG. 4) are properly aligned with the respective bearing recesses 34,36 (FIG. 3) and the pick module assembly is urged straight into the bearing recesses as discussed above. Once the bearings 30,32 are received in the recesses 34,36, with additional reference to FIG. 9*b*, the pick module assembly 16 is rotated or pivoted about the bearings 30,32 until the extending member 82 engages the actuator arm 76. In FIG. 9*b*, the actuator arm 76 is shown in an actuator arm 76 first position to which the arm 76 is urged toward by the spring 84 (FIG. 5). With additional reference to FIG. 9*c*, the pick module assembly is rotated further about the bearings into the actuator arm 76 against the urging of the spring 84, i.e., a force is applied on the pick module assembly 16 that overcomes the urging of the spring 84, thereby pivoting the actuator arm 76 toward an actuator arm second position. Upon continued rotation, with still additional reference to FIG. 9*d*, the extending member 82 passes a short arm 124 of the fork 80 and the spring 84 causes the fork 80 to snap onto the extending member 82. With the extending member 82 received in the fork 80, the spring 84 urges the actuator arm 76 back toward the arm first position and the pick module assembly is urged to rotate about the bearings 30,32. In addition to maintaining the pick module assembly 16 in the operative position, the actuator arm 76 also controls the radial position of the pick module assembly 16 relative to the bearings 30,32. More particularly, the urging of the pick module assembly 16 about the bearings 30,32 by the spring (clockwise in FIG. 9*d*) urges or biases the nudger roller toward an associated stack of print media carried in the tray 12.

When the pick module assembly 16 is properly installed, the tray 12 can be loaded with a stack of print media and inserted in the frame 14. Once the printer device 10 senses that the tray 12 has been inserted it turns on the lift motor (not shown), raising the lift plate 86 and the associated stack of media. The uppermost sheet of the associated stack of print media contacts the nudger roller 20 of the pick module assembly 16 and rotates the pick module assembly 16 slightly about the bearings 30,32. The extending member 82, which is captured by the actuator fork 80, rotates the actuator arm 76 when the engagement of the print media causes the pick module assembly 16 to rotate. As the actuator arm 76 rotates, a flag 128 on the arm 76 actuates a sensor (not shown) connected to the frame 14 indicating to the printer device that the media has reached the correct height for feeding and that the lift motor can be turned off. To pick the top sheet of the stack of print media, the driven gear 72 is driven by the associated drive gear which rotates the rollers 18,20. The nudger roller 20 moves the top sheet from the stack so that the leading edge enters the nip formed by the pick roller 18 and the separator 22. The pick roller then drives the sheet of media up into the print device 10 for printing. If multiple sheets attempt to enter the nip, they are separated by the separator so that only a single sheet will be fed past the nip.

Removal of the pick module assembly 16 may be desirable if the pick module assembly is to be replaced such as may be necessary when either or both of the treads 52,60 wear out. To remove the pick module assembly 16 from the frame 14, a user first removes the media tray 12 to gain access to the underside of the pick module assembly 16. A user then applies a force to the actuator arm 76 to pivot the arm against the urging of the spring 84. More particularly, with reference to FIGS. 3 and 10*a*, the actuator assembly includes an actuator arm release lever 126 connected to the arm 76. A force is applied to the release lever 126 in the direction of arrow F which pivots the arm 76 toward the arm second position against the urging of the spring 84 and pivots the pick module assembly 16 about the bearings 30,32.

Figure 10A:
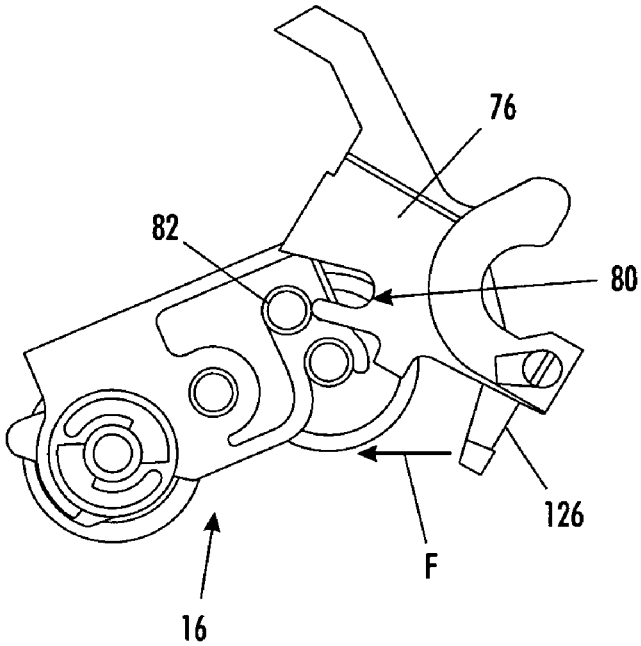
FIG. 10*a* is a partial view of the actuator arm assembly and the pick module assembly showing where a force is to be applied on the actuator arm assembly to unlock the pick module assembly.
Figure 10B:
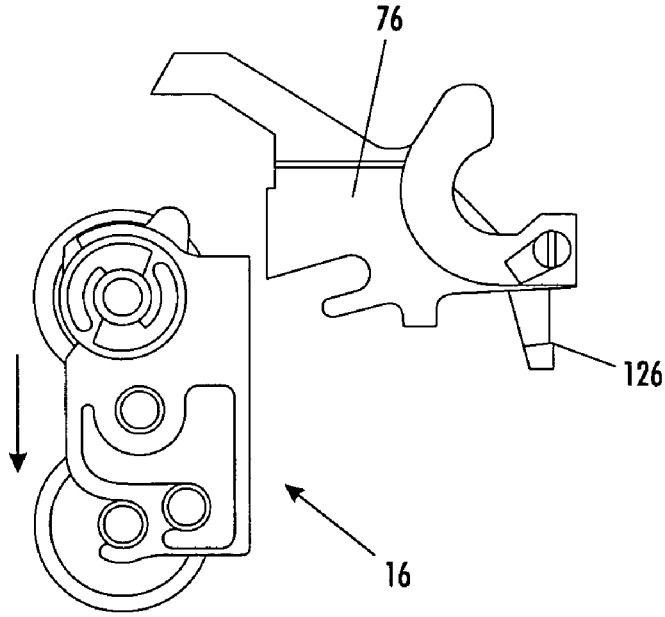
FIG. 10*b* is a partial view of its actuator arm assembly and the pick module assembly showing the pick module assembly in the semi-engaged position and ready for removal from the frame.

Due to the orientation of the pick module assembly 16 in the illustrated embodiment, upon application of sufficient force to the release lever 126, the extending member 82 disengages from the fork 80 of the arm 76 and gravity causes the pick module assembly 16 to rotate away from the arm 76 (clockwise in FIG. 10*a*). More specifically, gravity causes the pick module assembly 16 to move to the semi-engaged position. As already discussed, in the semi-engaged position, the bearings 30,32 are aligned so that the pick module assembly 16 can be readily disconnected from the frame 14. Moreover, the nudger roller 20 hangs below the pick roller 18 permitting a user a portion of the assembly 16 that is easily graspable and able to be used to pull the assembly 16 from the frame 14. The user then pulls straight down on the pick module assembly 16 to disconnect it from the frame 14. Thus, the relatively easy removability of the pick module assembly 16 enables a user to be able to relatively easily replace the pick module assembly when desired.

To install a new pick module, the user holds the pick module assembly 16 in a vertical orientation (i.e., with the pick roller 18 above the nudger roller 20), and pushes it up into the bearing recesses 34,36 of the frame 14. The flexible bearings 30,32 on the pick module assembly 16 allow the assembly to snap into and connect to the rigid printer frame 14 as described above. The user then pushes on the nudger roller 20 to rotate the pick module assembly 16 up into the recess 24 in the frame 14. As the pick module assembly 16 rotates up, the extending member or pin 82 contacts the underside of the actuator arm fork 80. The user must continue to rotate the nudger roller 20 up far enough so that the pick module assembly 16 rotates past a horizontal position and the pin 82 slides past the lower part of the actuator arm fork 80 and engages into the fork 80. The user then reinserts the media tray 12.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A sheet feeder and separator assembly for separating and sequentially feeding individual print media sheets from a stack thereof, comprising:

a frame having at least one bearing recess;

a print media tray carried by said frame;

a separator connected to said print media tray; and a pick module assembly removably connected to said frame adjacent said print media tray, said pick module assembly including a pick roller adjacent said separator to form a nip and at least one flexible bearing removably received in said at least one bearing recess and removably connecting said pick module assembly to said frame, wherein said at least one bearing recess has an opening width that is smaller than a diameter of said at least one flexible bearing requiring said diameter of said at least one flexible bearing to be selectively variable along a first axis aligned with said opening width of said at least one bearing recess for insertion and removal of said at least one flexible bearing from said at least one bearing recess.

2. The sheet feeder and separator assembly of claim 1 wherein said at least one flexible bearing has a variable first dimension along a first axis for allowing removal of said at least one flexible bearing from said at least one bearing recess when said first dimension is aligned with said opening width of said at least one bearing recess and has a substantially constant second dimension along a second axis angularly offset relative to said first axis for preventing removal of said at least one flexible bearing from said at least one bearing recess when said second dimension is aligned with said opening width.

3. The sheet feeder and separator assembly of claim 2 wherein said second axis is approximately normal to said first axis.

4. The sheet feeder and separator assembly of claim 2 wherein said at least one flexible bearing fixes the position of the pick module assembly along said second axis relative to the frame when said second dimension is aligned with said opening width.

5. The sheet feeder and separator assembly of claim 1 wherein said frame is constructed of a substantially rigid material that resists deformation when said at least one flexible bearing is inserted in or removed from said at least one bearing recess.

6. The sheet feeder and separator assembly of claim 1 wherein said pick module assembly includes:

a pick frame; and a pick roller shaft rotatably mounted to said pick frame by said at least one flexible bearing and having said pick roller connected to said pick roller shaft, said pick roller rotatably fixed to said pick roller shaft when said pick roller shaft is rotated in a first direction and said pick roller rotatable relative to said pick roller shaft when said pick roller shaft is rotated in a second direction.

7. The sheet feeder and separator assembly of claim 6 wherein said at least one flexible bearing includes:

a grooved portion received within a pick frame bearing recess to rotatably connect said at least one flexible bearing to said pick frame;

at least one walled portion axially disposed in said grooved portion to limit rotation of said at least one flexible bearing within said pick frame bearing recess; and a pair of opposed axially extending portions having opposed radial portions adjacent said pick roller shaft that have a substantially fixed diameter thereacross and opposed fingers extending from said radial portions and being radially spaced from said pick roller shaft that have a flexible, varying diameter thereacross.

8. The sheet feeder and separator assembly of claim 6 wherein said pick module assembly further includes:

a nudger roller rotatably mounted to said pick frame adjacent said pick roller by a nudger shaft;

a pick roller gear rotatably fixed to said pick roller shaft;

a nudger roller gear rotatably fixed to said nudger shaft;

an idler gear rotatably mounted to said pick frame and engaged with said pick roller gear and said nudger roller gear so that rotation of said pick roller shaft causes rotation of said nudger roller; and a driven gear mounted to said pick roller shaft for connection to an associated drive gear.

9. The sheet feeder and separator assembly of claim 8 wherein said pick roller and said nudger roller each include frictional roller treads nonrotatably mounted thereto.

10. A sheet feeder and separator assembly for separating and sequentially feeding individual print media sheets from a stack thereof, comprising:

a frame having a pick module recess and a pair of bearing recesses adjacent thereto;

a print media tray carried by said frame;

a separator connected to said print media tray, and a pick module assembly removably connected to said frame adjacent said print media tray, said pick module assembly including a pick roller adjacent said separator to form a nip said pick module assembly having a pair of flexible bearings removably received in said pair of bearing recesses to removably connect said pick module assembly to said frame and removably mount said pick module assembly in said pick module recess, each of said pair of flexible bearings has a second dimension parallel with a respective opening width of said pair of bearing recesses so that said pick module assembly is locked to said frame until said pick module assembly is rotated so that a first dimension of each of said pair of flexible bearings is parallel with said respective opening width.

11. A sheet feeder and separator assembly for separating and sequentially feeding individual print media sheets from a stack thereof, comprising:

a frame having at least one bearing recess;

a print media tray carried by said frame;

a separator connected to said print media tray;

a pick module assembly removably connected to said frame adjacent said print media tray, said pick module assembly including a pick roller adjacent said separator to form a nip and at least one flexible bearing removably received in said at least one bearing recess and removably connecting said pick module assembly to said frame; and an actuator assembly having an arm pivotally mounted to said frame and including a fork that engages an extending member of said pick module assembly and a biasing mechanism urging said arm toward an arm first position that holds said pick module assembly in an operative position, said arm movable toward a second position when a force is applied that overcomes said urging of said biasing mechanism wherein said fork disengages said extending member allowing said pick module assembly to be moved to a semi-engaged position for disconnection from said frame.

12. The sheet feeder and separator assembly of claim 11 wherein gravity moves said pick module assembly from said operative position to said semi-engaged position when said force is applied against said urging of said biasing mechanism.

13. The sheet feeder and separator assembly of claim 11 wherein said separator is a retard roller assembly removably connected to said print media tray for replacement thereof, said retard roller assembly including a retard roller and a bias mechanism urging said retard roller into said pick roller.

14. The sheet feeder and separator assembly of claim 11 wherein said separator is one of an active retard roller, a semi-active retard roller and a separator pad.

* * * * *